United States Patent [19]

Irisawa et al.

[11] Patent Number: 5,059,855

[45] Date of Patent: Oct. 22, 1991

[54] DISCHARGE LAMP BASE CONSTRUCTION

[75] Inventors: Shinichi Irisawa; Yukio Wakimizu; Masakazu Nagasawa, all of Shimizu, Japan

[73] Assignee: Koito Manufacturing Co. Ltd., Shizuoka, Japan

[21] Appl. No.: 556,508

[22] Filed: Jul. 24, 1990

[30] Foreign Application Priority Data

Jul. 31, 1989 [JP] Japan ..... 1-198750

[51] Int. Cl.[5] ..... H01J 61/36; H01J 5/62

[52] U.S. Cl. ..... 313/318; 313/51; 362/263; 439/182; 439/226

[58] Field of Search ..... 313/318, 623, 113, 51; 439/226, 181, 182, 186; 362/296, 263

[56] References Cited

U.S. PATENT DOCUMENTS 4,533,851 8/1985 Block et al. ..... 313/51
4,542,316 9/1985 Hall et al. ..... 313/318
4,626,734 12/1986 Greiler ..... 313/113 X
4,722,039 1/1988 Gaugel ..... 313/113 X
4,823,049 4/1989 Sanders et al. ..... 313/623
4,879,491 11/1989 Hirozumi et al. ..... 313/318

*Primary Examiner*—Palmer C. DeMeo
*Attorney, Agent, or Firm*—Sughrue, Mion, Zinn, Macpeak & Seas

[57] ABSTRACT

A discharge lamp has a lamp assembly including a discharge lamp unit with a pair of lamp leads extending therefrom, and a base assembly including a pair of base leads electrically connected to the pair of lamp leads and mechanically supporting the lamp unit in position with respect to the base assembly. The base assembly comprises a hollow base structure of electrically insulating material molded in one piece with a partition dividing the interior thereof into a pair of completely isolated spaces. Electrically connected to the base leads, a pair of sheet metal conductors are received with clearances in the respective isolated spaces in order to preclude the possibility of an electric discharge taking place between the pair of conductors within the base structure.

7 Claims, 5 Drawing Sheets

DISCHARGE LAMP BASE CONSTRUCTION

BACKGROUND OF THE INVENTION

Our invention relates generally to electric lamps and particularly to discharge lamps. More particularly, our invention pertains to a base assembly which makes up a discharge lamp in combination with a discharge lamp assembly. Still more particularly, our invention features provisions in such a lamp base assembly for preventing an electric discharge between a pair of conductors extending through the base structure of the lamp base assembly.

The discharge lamp, sometimes referred to as gas discharge lamp, vapor lamp, etc., has been known and used extensively in which light is produced by an electric discharge between electrodes in a gas (or vapor) at low or high pressure. Essentially, the discharge lamp may be thought of as a combination of a lamp assembly and a base assembly. The lamp assembly comprises a discharge lamp unit with a pair of lamp lead wires extending therefrom. The base assembly comprises an insulating base structure with a pair of conductors extending therethrough, and a pair of base leads serving as both electrical and mechanical connections between the conductors and the lamp leads.

There has been a problem left unsolved with the discharge lamp. It is essential for the proper functioning of the discharge lamp that an electric discharge should take place only between the electrodes within the lamp envelope. Unless properly insulated from each other, however, the pair of conductors extending through the lamp base structure has been most likely to develop a discharge.

Hitherto, as far as we are aware, the pair of conductors has been insulated from each other by filling the hollow base structure with a plastic after this base structure has been molded with the conductors received in position therein. We object to this conventional solution because, unavoidably, the plastic filler that has been allowed to solidify within the preformed base structure develops interstices of microscopic dimensions. Such minute interstices are easy to create discharge paths between the conductors. Moreover, once a discharge has taken place through such interstices, the plastic filler has become carbonized along the discharge path. The carbonized path has made easier the occurrence of another discharge. Thus the useful life of the conventional discharge lamps has sometimes be shortened even though the lamp units themselves may be faultless.

SUMMARY OF THE INVENTION

We have hereby invented how to prevent, in a discharge lamp of the kind indicated, an electric discharge from taking place between the pair of conductors of the base assembly far more effectively, and without making the discharge lamp any more complex in construction, than heretofore.

Briefly, our invention may be summarized as a discharge lamp having a lamp assembly and a base assembly. The lamp assembly includes a discharge lamp unit with a pair of lamp lead means extending therefrom. Our invention is specifically directed to the improved construction of the base assembly comprising a hollow base structure of electrically insulating material. A partition of electrically insulating material is formed within the base structure to divide the interior thereof into a pair of isolated spaces for individually receiving a pair of conductors with clearances. A pair of base lead means connect the pair of conductors to the pair of lamp lead means both electrically and mechanically.

Thus, according to our invention, no discharge path is to be created between the pair of conductors as these are received with clearances in the spaces which are separated from each other by the partition molded together with the base structure. It will also be appreciated that, despite its marked effectiveness to prevent the occurrence of a discharge between the pair of conductors, the improved base assembly of our invention is even easier to fabricate than its conventional counterpart.

The above and other features and advantages of our invention and the manner of realizing them will become more apparent, and the invention itself will best be understood, from a study of the following description and appended claims, with reference had to the attached drawings showing a preferable embodiment of our invention.

DESCRIPTION OF THE PREFERRED EMBODIMENT

GENERAL

Figure 1:
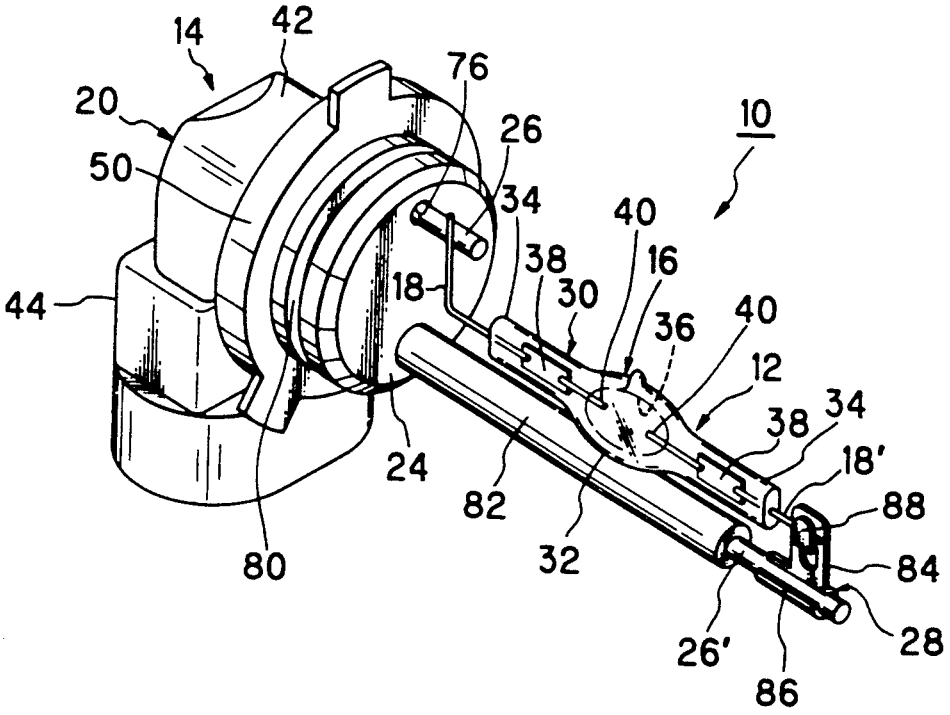
FIG. 1 is a perspective view of the discharge lamp embodying the principles of our invention.
Figure 2:
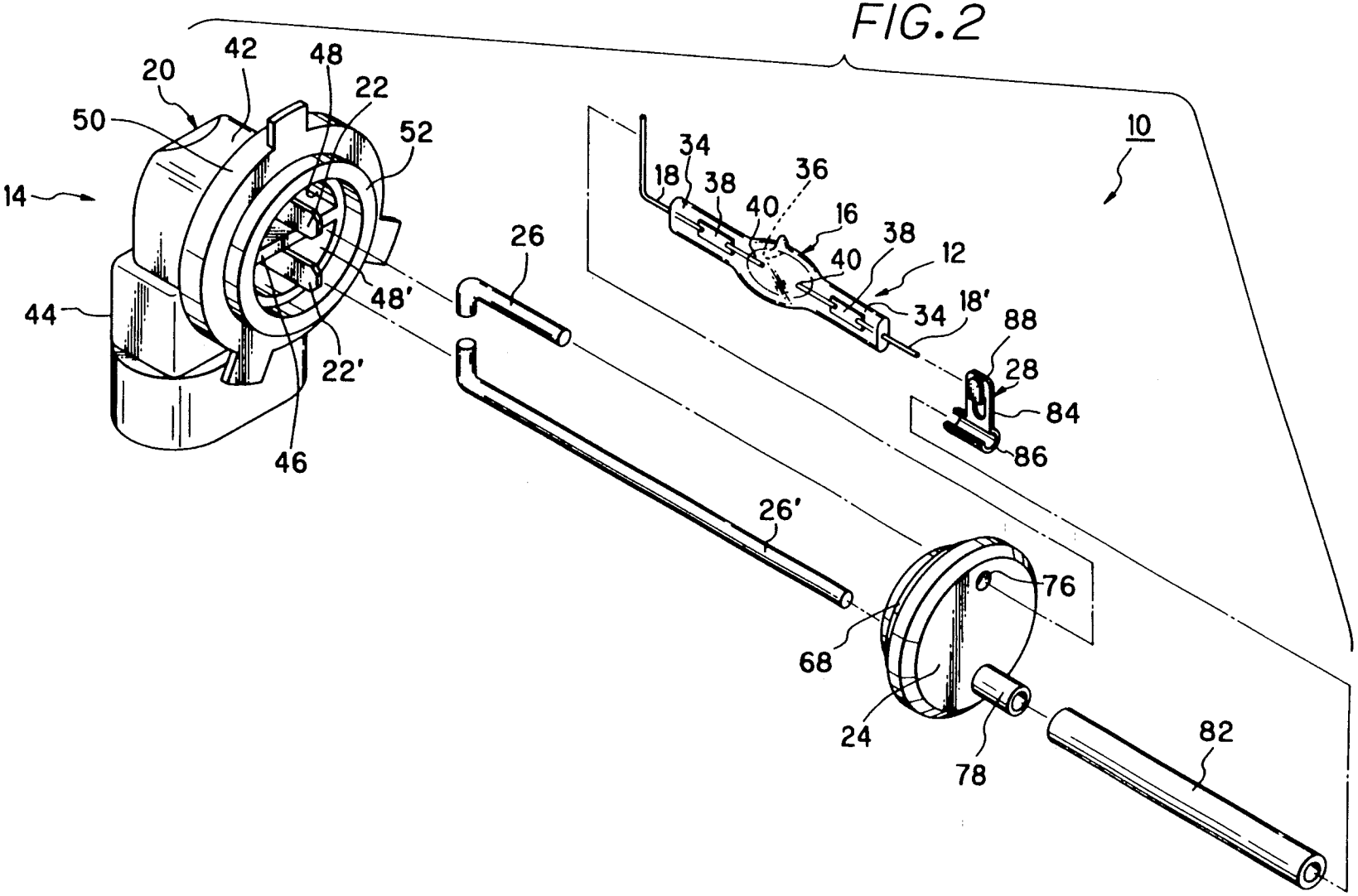
FIG. 2 is an exploded perspective view showing the discharge lamp of FIG. 1 disassembled and with its constituent parts or components shown in proper positional relationship to one another.
Figure 3:
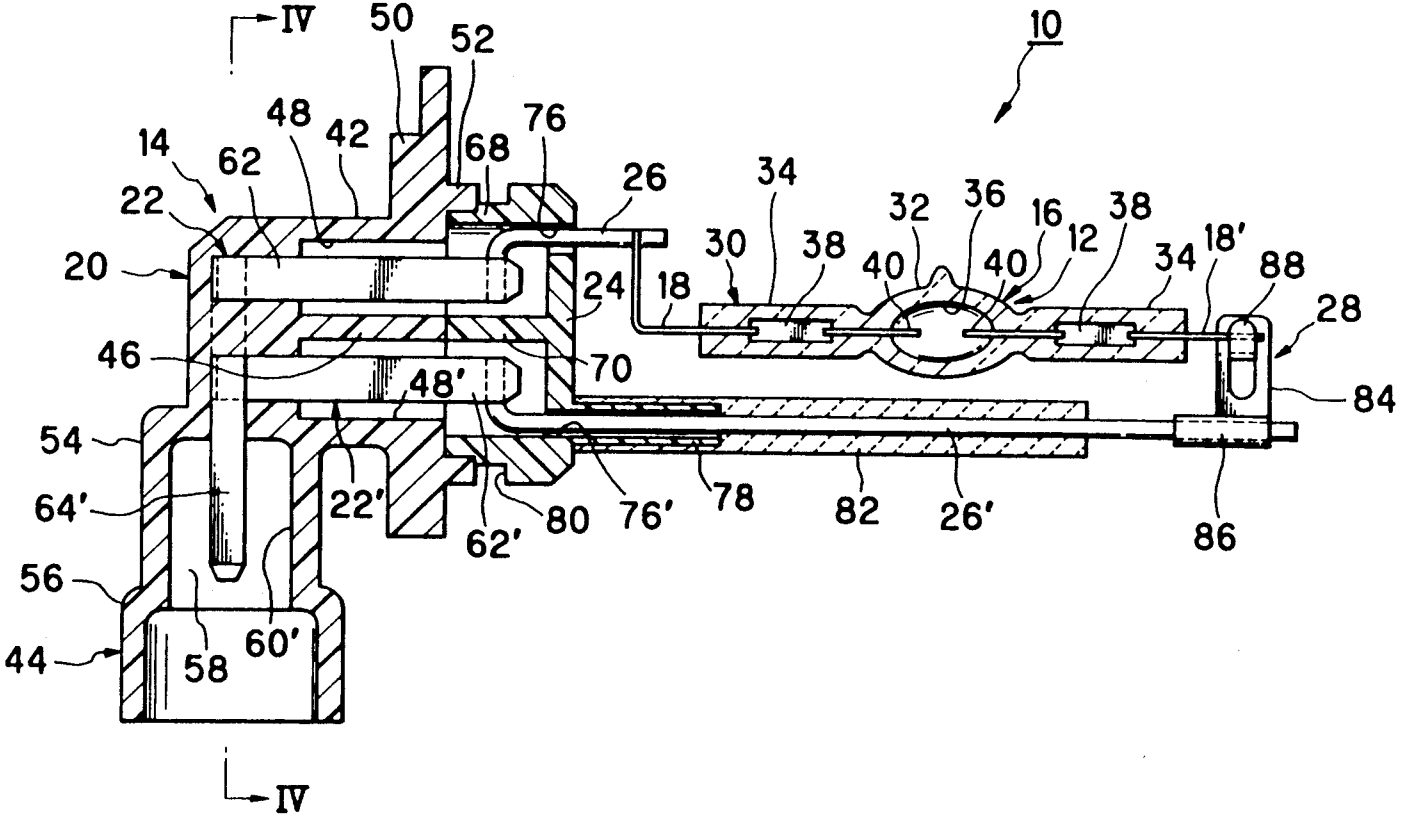
FIG. 3 is a longitudinal section through the discharge lamp.

We will now describe our invention in detail as embodied in the metallic halide discharge lamp illustrated in its entirety in FIGS. 1–3 and therein generally designated 10. Broadly, the discharge lamp 10 comprises a lamp assembly 12 and a base assembly 14. The lamp assembly 12 includes a discharge lamp unit 16 having a pair of lamp leads 18 and 18' extending therefrom.

The base assembly 14 includes a generally hollow base structure 20 of electrically insulating material with a pair of bladelike sheet metal conductors 22 and 22' extending therethrough, a base cover 24 of electrically insulating material closing an open end of the base structure 10, and a pair of base leads 26 and 26' electrically connecting the conductors 22 and 22' and the lamp leads 18 and 18', respectively. The base leads 26 and 26' also serve to mechanically support the discharge lamp unit 16 in position with respect to the base structure 20. Although the base lead 26 is joined directly to the lamp lead 18, the other base lead 26' is coupled to the other lamp lead 18' via a sheet metal lead connector 28.

We will discuss in more detail hereafter the above noted discharge lamp unit 16, base structure 20, pair of sheet metal conductors 22 and 22', base cover 24, pair of base leads 26 and 26', and lead connector 28, in that order and under separate headings. Such detailed discussion of the listed components will be followed by the description of how the lamp assembly 12 is mounted in position on the base assembly 14.

DISCHARGE LAMP UNIT

With reference to FIGS. 1-3 the discharge lamp unit 16 of the lamp assembly 12 has an envelope 30 of vitreous material. Generally elongated in shape, the envelope 30 has a globular body portion 32 and a pair of pinch seals 34 extending in the opposite directions from the body portion. The body portion 32 defines a hermetically sealed discharge chamber 36. Buried in the pinch seals 34, a pair of metal foils 38 are connected respectively to a pair of electrodes 40 which extend in part into the discharge chamber 36. The metal foils 38 are also connected to the pair of lamp leads 18 and 18' projecting in opposite directions from the pinch seals 34. The lamp lead 18 is bent into the shape of the capital L whereas the other lamp lead 18' is straight.

BASE STRUCTURE

Figure 4:
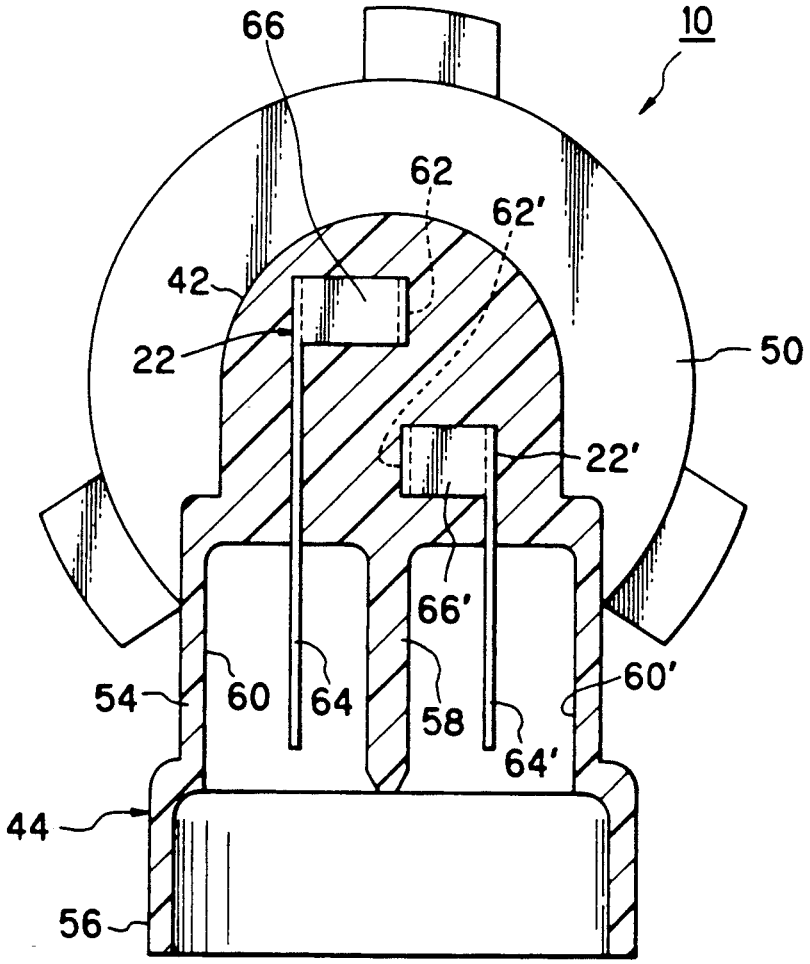
FIG. 4 is an enlarged transverse section through the base assembly of the discharge lamp, taken along the line IV—IV in FIG. 3.

The base structure 20 of the base assembly 14 appears not only in FIGS. 1-3 but also on an enlarged scale in FIG. 4. Molded from a plastic, the base structure 20 integrally comprises a tubular base body 42 and a hollow base extension 44 which are right angularly joined to each other. We recommend polyphenylene sulfide as a material of the base structure 20 by reason of its capability of withstanding high voltages.

FIG. 3 best indicates that the base body 42 has a closed end, shown directed to the left in this figure, and an open end away from the closed end. The base extension 44 is joined to the closed end of the base body 42 to serve as a connector of this discharge lamp 10. While the base body 42 is circular in cross sectional shape, the base extension 44 is of elliptical cross section.

The base body 42 has a partition 46 dividing the interior thereof into a pair of isolated spaces 48 and 48' in accordance with a feature of our invention. The pair of conductors 22 and 22' are partly received in these isolated spaces 48 and 48', respectively, with clearances. A flange 50 is formed around the open end of the base body 42. An annular rim 52 on the flange 50 is intended for engagement with the base cover 24.

As will be best understood from FIGS. 3 and 4, the base extension 44 comprises a first portion 54 joined directly to the base body 42, and a second portion 56 of greater cross sectional size, but of smaller longitudinal size, away from the base body. The first portion 54 of the base extension 44 has formed therein a second partition 58 dividing the interior thereof into a pair of isolated spaces 60 and 60'. The pair of conductors 22 and 22' have portions received in these isolated spaces 60 and 60', respectively, with clearances.

Sheet Metal Conductors

Reference is directed to FIGS. 3 and 4 for the closer study of the pair of conductors 22 and 22' extending through the base structure 20. Each fabricated from a single piece of sheet metal, the pair of conductors 22 and 22' comprise first arms 62 and 62' extending through the base body 42, second arms 64 and 64' extending through the base extension 44, and short connective portions 66 and 66' joining the first and the second arms at a right angle to each other.

As seen in FIG. 4, the connective portion 66 of the first conductor 22 has its right hand side joined to the first arm 62, and its left hand side to the second arm 64. The connective portion 66' of the second conductor 22' has its left hand side joined to the first arm 62', and its right hand side to the second arm 64'. It will therefore be understood that the first arms 62 and 62' of both conductors 22 and 22' are disposed in coplanar relationship to each other, whereas their second arms 64 and 64' are disposed opposite each other with a spacing therebetween.

The pair of conductors 22 and 22' may be mounted in position within the base structure 20 by "insert molding" of the base structure with the conductors 22 and 22'. The conductors 22 and 22' can be immovably supported with respect to the base structure 20 by having their connective portions 66 and 66' and the neighboring parts of the arms 62, 62', 64 and 64' embedded in the relatively thick end closure of the base body 42.

The first arms 62 and 62' of the conductors 22 and 22' are mostly received in the pair of isolated spaces 48 and 48' in the base body 42 with relatively large clearances. The second arms 64 and 64' of the conductors 22 and 22' are mostly received in the isolated spaces 60 and 60' in the base extension 44 with relatively large clearances. Experiment has proved that the base assembly 14 of the above improved construction according to our invention can prevent an electric discharge from taking place between the pair of conductors 22 and 22' far more effectively than heretofore.

An inspection of FIG. 3 will reveal that the first arms 62 and 62' of the conductors 22 and 22' partly project out of the base body 42 toward the lamp assembly 12. The first arms 62 and 62' project to such an extent as to make possible the welding of the pair of base leads 26 and 26' to their projecting ends.

Base Cover

Figure 5:
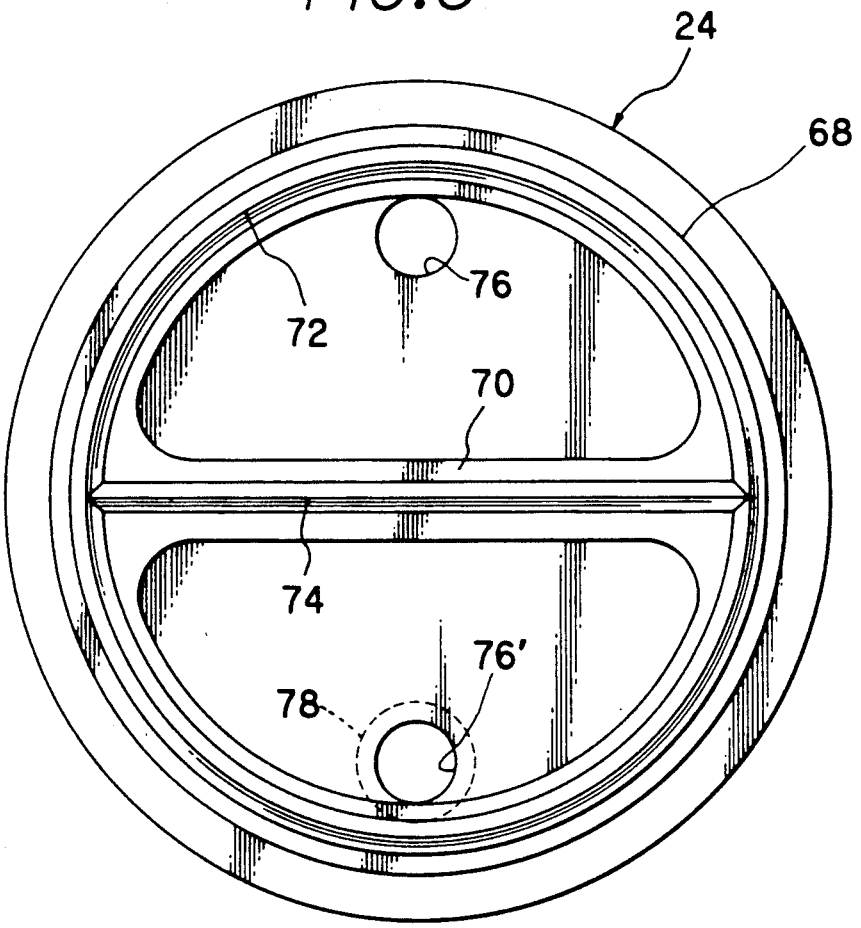
FIG. 5 is an enlarged elevation of the base cover forming a part of the base assembly.

The base cover 24 appears in FIGS. 1-3 and is also shown in FIG. 5 on an enlarged scale and as seen from its side held against the base structure 20. It is to be noted that FIG. 5 shows the base cover 24 in its state before being affixed, typically by ultrasonic fusion, to the base structure 20.

Molded from the same material as the base structure 20, the base cover 24 takes the form of a disk complete with an annular rim 68 formed on one side of the disk, and a partition 70 extending diametrally of the annular rim. Ridges 72 and 74 of triangular cross section are formed on the end faces of the annular rim 68 and partition 70 in order to expedite the ultrasonic fusion of the base cover 24 to the base structure 20.

Two holes 76 and 76' are formed in the base cover 24 to permit the pair of base leads 26 and 26' to extend therethrough. Molded in one piece with the base cover 24 in axial alignment with the hole 76', a hollow boss 78 extends from the base cover in a direction away from the base structure 20.

For attaching the base cover 24 to the base structure 20, the annular rim 68 of the base cover may be inserted in the annular rim 52 on the base flange 50, with the partition 70 of the base cover held in a coplanar relation to the partition 46 of the base structure. Ultrasonic vibrations may then be applied to cause the coalescence of the base structure 20 and base cover 24 into one body through the ridges 72 and 74 on the base cover. FIG. 3 shows at 80 an annular groove defined between base structure 20 and base cover 24. A suitable packing or sealing ring may be fitted in this groove 80 in order to make the joint between base structure 20 and base cover 24 still more impervious to water and other fluids.

It will also be observed from FIG. 3 that the partition 70 within the base cover 24 into a pair of isolated spaces in open communication with the similar spaces 48 and 48′ in the base structure 20. The end portions of the pair of conductors 22 and 22′, projecting from within the base structure 20, are received with clearances in these isolated spaces in the base cover 24 in order to prevent an electric discharge from taking place between such end portions of the conductors.

Base Leads

As illustrated in FIGS. 1–3, the pair of base leads 26 and 26′ are made of wires of greater diameter, and hence of greater rigidity, than the pair of lamp lead wires 18 and 18′. Such sturdier base lead wires are needed for mechanically supporting the discharge lamp unit 12 in position with respect to the base assembly 14, in addition to providing electrical connections between the pair of conductors 22 and 22′ and the pair of lamp leads 18 and 18′. The base leads 26 and 26′ have end portions that are bent right angularly to be welded firmly to those ends of the conductors 22 and 22′ which project from within the base structure 20.

Of course, the base leads 26 and 26′ may be welded o the conductors 22 and 22′ before the open end of the base structure 22 is closed by the base cover 24. Then the base cover 24 may be attached to the base structure 22, receiving the base leads 26 and 25′ in its holes 76 and 76′.

The base lead 26′ is much (normally four to five times) longer than the other base lead 26, and both base leads 26 and 26′ extend parallel to each other. Thus, as best pictured in FIGS. 1 and 3, the elongate discharge lamp unit 16 can be supported between the base leads 26 and 26′ so as to extend in the same direction as the base leads. The shorter base lead 26 is welded directly to the L-shaped lamp lead 18. The longer base lead 26′ is mechanically and electrically connected to the other lamp lead 18′, which is straight, via the lead connector 28.

Seen at 82 in FIGS. 1–3 is a tubular sheath of electrically insulating material (e.g. glass or ceramics) sleeved upon all but one end portion, away from the base assembly 14, of the longer base lead 26′. The sheath 82 is closely fitted at one end over the hollow boss 78 on the base cover 24. Further, preferably, an inorganic adhesive may be filled in between base lead 26′ and sheath 82.

Lead Connector

Reference is directed again to FIGS. 1–3 for the following discussion of the lead connector 28. The lead connector 28 is shown as a piece of sheet metal integrally comprising a flat bridge portion 84, a sleeve portion 86 formed by curling one end of the bridge portion, and a clip portion 88 formed by cutting and bending part of the bridge portion. The sleeve portion 86 is pressfitted over the exposed end portion of the longer base lead 26′. The clip portion 88 engages the straight lamp lead 18′. The bridge portion 84 serves to join the sleeve portion 86 and the clip portion 88.

Mounting of the Discharge Lamp Unit

We have already explained how the base assembly 14 of the discharge lamp 10 is assembled. We will now describe how the discharge lamp unit 16 is mounted in position on the base assembly 14. Before the mounting of the lamp unit 16, however, the lead connector 28 must be mounted on the longer base lead 26′.

The sleeve portion 86 of the lead connector 28 may first be pressfitted over the exposed end portion of the longer base lead 26′ by taking advantage of the resiliency of the sheet metal of which the lead connector is made. Then the angular position of the lead connector 28 on the base lead 26′ may be adjusted so that the flat bridge portion 84 of the lead connector may lie approximately in a plane containing the pair of base leads 26 and 26′. Then, with the bridge portion 84 held in the required angular position, the sleeve portion 86 may be spot welded or otherwise secured to the base lead 26′.

We can now proceed to the mounting of the lamp assembly 12 on the base assembly 14. First, the L shaped lamp lead 18 may be tentatively held against the shorter base lead 26, and the straight lamp lead 18′ may be engaged with the clip portion 88 of the lead connector 28. Then the position of the lamp assembly 12 may be adjusted so that the discharge lamp unit 16 may extend parallel to the pair of base leads 26 and 26′ in a plane containing both base leads. The position of the lamp assembly 12 may also be adjusted in the longitudinal direction of the base leads 26 and 26′. FIG. 3 best illustrates the required longitudinal position of the lamp assembly 12 with respect to the base leads 26 and 26′.

Then, with the lamp assembly 12 maintained in the required position, the L shaped lamp lead 18 may be spot welded to the shorter base lead 26. The straight lamp lead 18′ may also be spot welded to the lead connector 28.

Although we have shown and described our invention very specifically and as embodied in the metallic halide discharge lamp, we do not wish our invention to be limited by the exact details of this disclosure. A variety of modifications, alterations and adaptations of the illustrated embodiment may be made to conform to design preferences or to the requirements of each specific application of the invention, without departing from the scope of the following claims.

What we claim is:

1. A discharge lamp having a lamp assembly and a base assembly, the lamp assembly including a discharge lamp unit with a pair of lamp lead means extending therefrom, wherein the improvement resides in the base assembly comprising:
   (a) a hollow base structure of electrically insulating material having an open end and a closed end;
   (b) a partition within the base structure formed in one piece therewith, the partition extending between the open and closed ends of the base structure and dividing the interior thereof into a pair of isolated spaces;
   (c) a pair of conductors rigidly received with clearances, one in each of the isolated spaces in the base structure, and each having a first end anchored to the closed end of the base structure and a second end projecting through the open end of the base structure;
   (d) a pair of base lead means electrically connecting the second ends of the pair of conductors to the pair of lamp lead means and mechanically supporting the discharge lamp unit in position with respect to the base assembly; and
   (e) a base cover of electrically insulating material closing the open end of the base structure, the base cover having a pair of openings through which extend the pair of base lead means.

2. The discharge lamp of claim 1 wherein the base assembly further comprises:
   (a) a hollow base extension of electrically insulating material integrally joined to the closed end of the base structure;

(b) a second partition within the base extension formed in one piece therewith for dividing the interior thereof into a pair of isolated spaces; and (c) a second pair of conductors rigidly received with clearance one in each of the isolated spaces in the base extension and each electrically connected at one end to the first end of one of the first recited pair of conductors.

3. The discharge lamp of claim 2 wherein each of the second pair of conductors is made of sheet metal in one piece with one of the first pair of conductors.

4. A discharge lamp comprising:

(a) a lamp assembly comprising:

(1) a discharge lamp unit; and (2) a pair of lamp leads extending from the discharge lamp unit; and (b) a base assembly comprising:

(1) a hollow base structure of electrically insulating material having an open end and a closed end;

(2) a first partition within the base structure formed in one piece therewith, the first partition extending between the open and the closed end of the base structure and dividing the interior of the base structure into a pair of isolated spaces;

(3) a pair of conductors received with clearances in the respective isolated spaces in the base structure and each having a first end anchored to the closed end of the base structure and a second end projecting from the base structure through the open end thereof;

(4) a hollow base cover of electrically insulating material closing the open end of the base structure;

(5) a second partition within the base cover formed in one piece therewith and dividing the interior of the base cover into a pair of isolated spaces receiving the second ends of the pair of conductors with clearances; and (6) a pair of base leads extending through the base cover and electrically connecting the second ends of the pair of conductors to the pair of lamp leads, the base leads being rigid enough to mechanically support the discharge lamp unit in position with respect to the base assembly.

5. The discharge lamp of claim 4 wherein the discharge lamp unit is generally elongated and has a pair of opposite ends, with the pair of lamp leads extending from the opposite ends of the discharge lamp unit, and wherein one of the pair of base leads is longer than the other and extends in a direction substantially parallel to the direction in which the discharge lamp unit is elongated.

6. The discharge lamp of claim 5 further comprising:

(a) a hollow boss formed in one piece with the base cover and receiving part of the longer base lead; and (b) a sheath of electrically insulating material covering the longer base lead and closely fitted at one end over the hollow boss on the base cover.

7. The discharge lamp of claim 5 further comprising a lead connector connecting the longer base lead to one of the lamp leads, the lead connector being a piece of sheet metal having a sleeve portion fitted over the longer base lead, a clip portion engaging said one lamp lead, and a bridge portion joining the sleeve portion and the clip portion.

* * * * *